US011612242B2

(12) United States Patent
Berastain

(10) Patent No.: US 11,612,242 B2
(45) Date of Patent: Mar. 28, 2023

(54) SUPPORT DEVICE FOR COUNTERTOPS

(71) Applicant: Dustin Berastain, Mooresville, NC (US)

(72) Inventor: Dustin Berastain, Mooresville, NC (US)

( * ) Notice: Subject to any disclaimer, the term of this patent is extended or adjusted under 35 U.S.C. 154(b) by 67 days.

(21) Appl. No.: 17/352,557

(22) Filed: Jun. 21, 2021

(65) Prior Publication Data

US 2022/0265042 A1 Aug. 25, 2022

Related U.S. Application Data

(60) Provisional application No. 63/152,254, filed on Feb. 22, 2021.

(51) Int. Cl.

| | |
|---|---|
| ***F16M 11/00*** | (2006.01) |
| ***A47B 77/06*** | (2006.01) |
| ***A47B 9/20*** | (2006.01) |
| ***A47B 3/00*** | (2006.01) |

(52) U.S. Cl.

CPC ..... *A47B 77/06* (2013.01); *A47B 3/002* (2013.01); *A47B 9/20* (2013.01)

(58) Field of Classification Search

None

See application file for complete search history.

(56) References Cited

U.S. PATENT DOCUMENTS

| | | | | |
|---|---|---|---|---|
| 5,107,775 | A * | 4/1992 | Langlais | A47B 9/14 248/188.5 |
| 2019/0261771 | A1* | 8/2019 | Patton | A47B 9/14 |
| 2020/0391372 | A1* | 12/2020 | Strempke | B25H 3/006 |
| 2021/0059399 | A1* | 3/2021 | Chen | F16M 11/38 |
| 2021/0112968 | A1* | 4/2021 | Ponomar | A47B 3/02 |

FOREIGN PATENT DOCUMENTS

| | | | | |
|---|---|---|---|---|
| DE | 102006040306 | A1 * | 5/2007 | A47B 3/002 |
| DE | 202021002287 | U1 * | 9/2021 | |

* cited by examiner

*Primary Examiner* — Steven M Marsh

(74) *Attorney, Agent, or Firm* — Brennan, Manna & Diamond, LLC

(57) ABSTRACT

The present invention relates to a 'prop up' or support device for supporting counters or sinks during renovation, restoration, mitigation, or other similar situations. More specifically, the prop up device is a rectilinear shaped telescoping device having telescoping arms that can extend to different heights to support kitchen counters, bars, or sinks of different heights, and ensures the kitchen remains functional during repairs, renovations, or the like. The prop up device enables the telescoping arms to easily collapse, fold, and store when the support device is in the storage orientation (i.e. not in use).

20 Claims, 3 Drawing Sheets

SUPPORT DEVICE FOR COUNTERTOPS

CROSS-REFERENCE TO RELATED APPLICATION

The present application claims priority to, and the benefit of, U.S. Provisional Application No. 63/152,254, which was filed on Feb. 22, 2021 and is incorporated herein by reference in its entirety.

FIELD OF THE INVENTION

The present invention relates generally to prop-up devices. More specifically, the present invention relates to a collapsible and foldable mounting bracket for counters that leave the occupant with a working kitchen during mitigation, remediation or renovation. The foldable bracket is a generally rectangular-shaped telescoping mounting device comprising of two arms, a base and a top supporting member, that supports the kitchen counters or sinks when cabinet boxes and faces are removed during renovation or restoration. The uniquely designed foldable bracket allows the users to adjust the height of the arms of the bracket to support kitchen counters/sinks of different heights. The base and the top supporting member comprise a hollow space to accommodate telescoping arms and allows the mounting bracket to be easily folded. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, during mitigation, remediation or renovation in repairs or other situations, the lower cabinetry in kitchens often times is required to be removed. When the lower cabinets, doors, and/or faces are removed, the kitchen counter and sink become nonfunctional and the occupants are left without a functioning kitchen. The renovation and/or restoration may take a great deal of time, that causes the occupants to either shift their kitchen to another room or move out of the home and stay elsewhere resulting in additional expenses. However, not everyone can afford the added expenses of living in a completely different place.

With a nonfunctional kitchen, individuals may be unable to use the kitchen for cooking and other purposes, thereby leading to difficult living conditions. Generally, professionals responsible for renovation of kitchens utilize 2 inch by 4 inch lumber to support kitchen counters or sinks in the times of cabinet replacement, renovations, or other similar situations. However, use of 2 inch by 4 inch lumber to provide support to kitchen counters or sinks is not reliable and there is always a risk of slipping of these support devices. Additionally, the 2 inch by 4 inch wood supports are of predetermined length and professionals face difficulty in accommodating support for kitchen counters of different heights. Additionally, the 2 inch by 4 inch lumber supports are often untidy and unprofessional in appearance, which makes the kitchen look unappealing.

The nonprofessional may look for other remedies to prop up or support the underside of the kitchen counter or sink. However, presently used solutions can be unsupportive and result in slip outs, that can cause damage to the kitchen counters/sinks and add to the overall expenses of the renovation, upgrade, or repair. Also, in situations where a 2 inch by 4 inch wood support or other propping device is used, slip-outs while using the kitchen counter or sink can cause severe bodily injuries.

Therefore, there exists a long felt need in the art for a device for supporting kitchen counters or sinks during repairs, renovation, restoration, or other similar situations. There is also a long felt need in the art for a prop-up device for kitchen counters or sinks that is adjustable in height and can easily support kitchen counters of different heights. Additionally, there is a long felt need in the art for a prop up device that eliminates the need to shift the kitchen to another room or to move out of the home when the kitchen in nonfunctional during renovation or repairs. There is a long felt need in the art for a support bracket for supporting kitchen counters that does not add to the expenses of the users and provides a cleaner and more professional look. Moreover, there is a long felt need in the art for a prop up device for kitchen counters that ensures the kitchen counters or sinks remain functional during renovation, remediation or restoration, and for a support or bracket device that is reliable and does not slip out. Furthermore, there is a long felt need in the art for a prop-up device that remains stable while standing in the place of lower cabinets under kitchen counters or sinks and does not cause injuries to the users. Finally, there is a long felt need in the art for a prop up device that can be easily used by professionals and nonprofessionals to support kitchen counters/sinks during renovation, remediation, mitigation, or other similar situations.

The subject matter disclosed and claimed herein, in one embodiment thereof, comprises a collapsible and foldable brace for kitchen counters. The brace includes a pair of fixed length longitudinal upper arms. The upper arms are attached to a lateral top member. A pair of telescoping arms wherein each telescoping arm is pivotably attached to one of the upper arms. A sleeve for extending and retracting each telescoping arm therefrom, respectively, for increasing or decreasing longitudinal length of the brace. The sleeves are attached to a base member of the brace device. The brace is collapsed by pushing the top member vertically down, thereby enabling a pivotably-connected upper arm and telescoping arm to pivot through the hinge connection, thereby allowing the top member and the base to accommodate the upper arms and the sleeves wherein the telescoping arms are enclosed by the sleeves in a retracted position.

In this manner, the novel prop-up device of the present invention accomplishes all of the forgoing objectives, and provides a relatively safe, easy, and convenient solution to support kitchen counters or sinks during renovation, remediation, mitigation, or other similar situations. The prop-up device of the present invention is also user-friendly, as it ensures the kitchen remains functional during renovation, and eliminates the need to shift the kitchen to another room or move out of the home thereby incurring additional expenses. Additionally, the prop-up device does not slip out easily and can be used to support kitchen counters of different heights as per the desires and requirements of the users.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a collapsible and foldable brace for counters and sinks. The brace has telescoping arms and is configured to be used in place of lumber to support counters/sinks when cabinet boxes, frames, doors and faces are removed. The brace further comprises: a lateral top supporting hollow member to contact the underside of a counter; a lateral hollow base to place the brace on a surface; a first longitudinal upper arm connected to the top supporting member at a top end; the first upper arm is hingedly-connected to a first telescoping arm at the bottom end; the telescoping arm is configured to extend and retract from a telescoping sleeve using an adjuster knob; and, the sleeve is fastened to the base. The brace also has a second longitudinal upper arm connected to the top supporting member at a top end of the second longitudinal upper arm. The second upper arm is hingedly connected to a second telescoping arm at a bottom end. The second telescoping arm is configured to extend and retract from a second telescoping sleeve using an adjuster knob. The sleeve is fastened to the base. The upper arms and the telescoping arms are configured to selectively collapse, thereby allowing the top supporting member to be positioned proximal to and aligned with the base member such that the first upper arm and the second upper arm are laterally accommodated by the top member. The first and second sleeves, with respective retracted telescoping arms, are laterally accommodated by the base member wherein the top member and the base member are proximal to each other when the device is in a folded orientation.

In a further embodiment of the present invention, a support device for counters and sinks is disclosed. The support device includes telescoping arms to adjust a longitudinal height of the support device. The device further includes hinged connections to collapse the device for easy carrying. The device further has two arm sections wherein each arm section has a fixed length arm hingedly-connected to a telescoping arm, wherein the telescoping arm is configured to extend or retract from a sleeve. The telescoping arm can be locked at a desired height using an adjuster knob that engages with one or more holes of the telescoping arm. The fixed-length arm and the telescoping arm pivotally move to align with each other to enable folding of the device.

In yet a further embodiment of the present invention, a foldable support device for supporting surfaces such as kitchen counters is disclosed. The device includes a pair of arms secured to a lateral top member of the device such that the top end of each arm of the pair of arms is pivotably-connected to the top member. A bottom end of each arm is pivotably connected to a telescoping arm through a hinge. The hinge pivots the arm and the telescoping arm from a first longitudinal position which is essentially coplanar to a second position where the arm and the telescoping arm align with each other. The telescoping arm extends or retracts from a sleeve that is pivotably connected to a base member. In a folded position, the top member accommodates the pair of arms and the base member accommodates the sleeves having enclosed telescoping arms and the top member overlays the base member.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
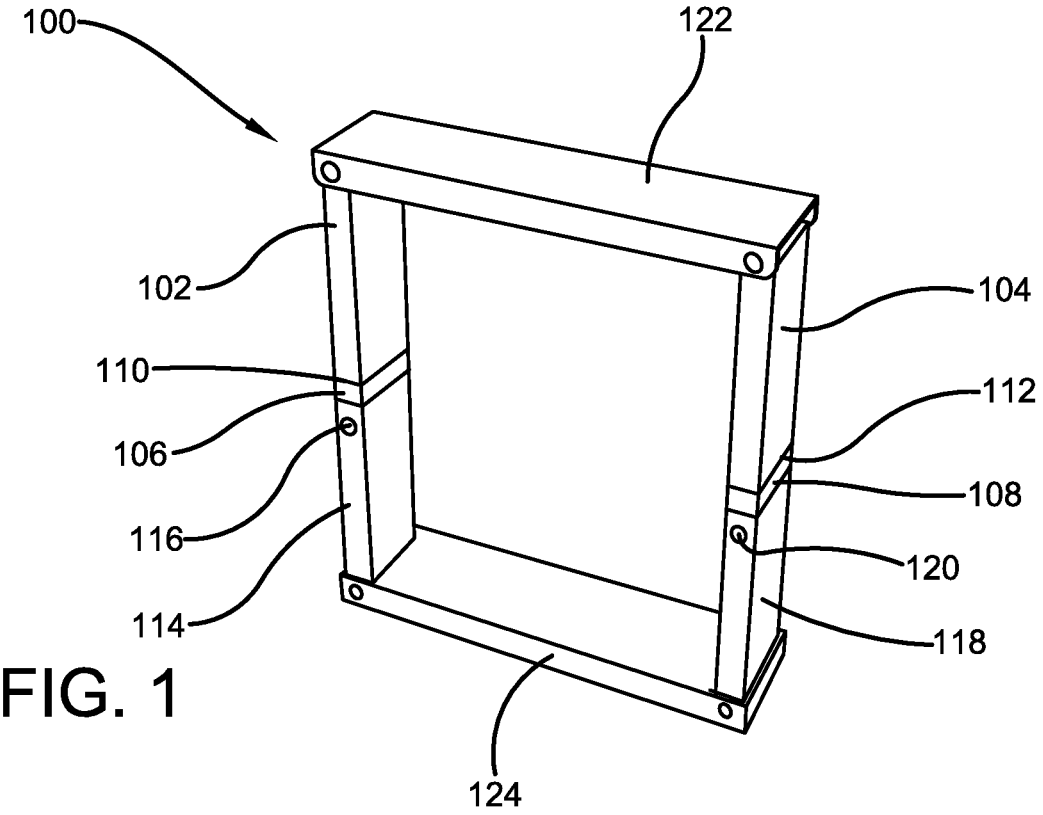
FIG. 1 illustrates a perspective view of one potential embodiment of a kitchen counter collapsible support device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a device for supporting kitchen counters or sinks during repairs, renovation, restoration, or other similar situations. There is also a long felt need in the art for a prop-up device for kitchen counters or sinks that is adjustable in height and can easily support kitchen counters of different heights. Additionally, there is a long felt need in the art for a prop up device that eliminates the need to shift the kitchen to another room or to move out of the home when the kitchen in nonfunctional during renovation or repairs. There is a long felt need in the art for a support bracket for supporting kitchen counters that does not add to the expenses of the users and provides a cleaner and more professional look. Moreover, there is a long felt need in the art for a prop up device for kitchen counters that ensures the kitchen counters or sinks remain functional during renovation, remediation or restoration, and for a support or bracket device that is reliable and does not slip out. Furthermore, there is a long felt need in the art for a prop-up device that remains stable while standing in the place of lower cabinets under kitchen counters or sinks and does not cause injuries to the users. Finally, there is a long felt need in the art for a prop-up device that can be easily used by professionals and nonprofessionals to support kitchen counters/sinks during renovation, remediation, mitigation, or other similar situations.

The present invention, in one exemplary embodiment, comprises a foldable support device for supporting surfaces such as kitchen counters. The device includes a pair of arms secured to a lateral top member of the device such that the top end of each arm of the pair of arms is pivotably-connected to the top member. A bottom end of each arm is pivotably-connected to a telescoping arm through a hinge. The hinge pivots the arm and the telescoping arm from a first longitudinal position which is essentially coplanar to a second position where the arm and the telescoping arm align with each other. The telescoping arm extends or retracts from a sleeve that is pivotably-connected to a base member. In a folded position, the top member accommodates the pair of arms and the base member accommodates the sleeves having enclosed telescoping arms and the top member overlays the base member.

Referring initially to the drawings, FIG. 1 illustrates a perspective view of one potential embodiment of a kitchen counter collapsible support device of the present invention in accordance with the disclosed architecture. The collapsible support device 100 of the present invention is configured to support counters and sinks when cabinet boxes, doors, frames, and faces are removed during mitigation, remediation, or renovation. The device 100 can be made from hard plastic, aluminum, or other suitable material that can withstand the weight of countertops and kitchen sinks. The device 100 includes telescoping arms to adjust for various counter heights. The device 100 can be used for supporting other types of counters or surfaces in order to prevent same from falling.

The components comprising the device 100 are generally square or rectilinear in structure. The device 100 includes a pair of upper arms having a left upper arm 102 and a right upper arm 104. The left upper arm 102 is connected to a left telescoping arm 106 through a first hinged joint 110. The right upper arm 104 is connected to a right telescoping arm 108 through a second hinged joint 112. The left telescoping arm 106 is configured to extend and retract from a left telescoping sleeve 114. The left telescoping sleeve 114 receives the left telescoping arm 106 through telescoping means and allows control of the extension and retraction therefrom using a first knob 116. The first knob 116 can be loosened to allow the left telescoping arm 106 to extend from the left sleeve 114 and when a desired height is reached, the first knob 116 is tightened by turning in a clockwise or counter-clockwise direction to lock the left telescoping arm 106 at the desired selectable height.

The right telescoping arm 108 is configured to extend and retract from a right telescoping sleeve 118. The right telescoping sleeve 118 receives the right telescoping arm 108 through telescoping means and allows control of the extension and retraction therefrom using a second knob 120. The second knob 120 can be loosened to allow the right telescoping arm 108 to extend from the right sleeve 118 and when a desired height is reached, the second knob 120 is tightened by turning in clockwise or counter-clockwise direction to lock the right telescoping arm 108.

The left upper arm 102 and the right upper arm 104 are connected to a top supporting member 122 using mechanical fasteners. The top supporting member 122 is used for supporting a counter surface thereon. The left sleeve 114 and the right sleeve 118 are connected to a base 124 using mechanical fasteners. The base 124 is placed on a surface such as a floor or ground thereby allowing the device 100 to remain stable and erect.

Using the telescoping arms 106, 108, the height of the collapsible support device 100 can be customized to support surfaces of different heights. The hinged joint 110 allows the pivot movement of the upper left arm 102 and the left telescoping arm 106 allowing both the upper left arm 102 and the left telescoping arm 106 to remain in a vertical orientation and aligned to each other. Similarly, using the second hinged joint 112 allows the pivot movement of the upper right arm 104 and the right telescoping arm 108 allowing both the upper right arm 104 and the right telescoping arm 108 to remain in a vertical orientation and aligned to each other. When both the hinges 110, 112 are used for pivoting, the support device 100 can be collapsed to a folded condition (see e.g., FIG. 3). The support device 100 of the present invention provides a collapsible and foldable brace for counters that leave an occupant with a working kitchen during mitigation, remediation or renovation. The support brace 100 is aesthetically appealing, portable, lightweight, economical, sturdy and offers a cleaner and more professional look than lumber currently used in the field.

The top member 122 and the base member 124 are hollow and dimensioned to accommodate the upper arms 102, 104 and the sleeves 114, 118 with enclosed telescoping arms 106, 108 respectively. In one potential embodiment, the length of each of the upper arms 102, 104, telescoping arms 106, 108, and the sleeves 114, 118 are the same and are of half of the length of the top member 122 and the base member 124. All the arm members of the device are pivotably connected, or slidingly engaged, to each other through a hinge or other mechanism allowing smooth movement for adjusting vertical height and folding the device into a collapsed state.

Figure 2:
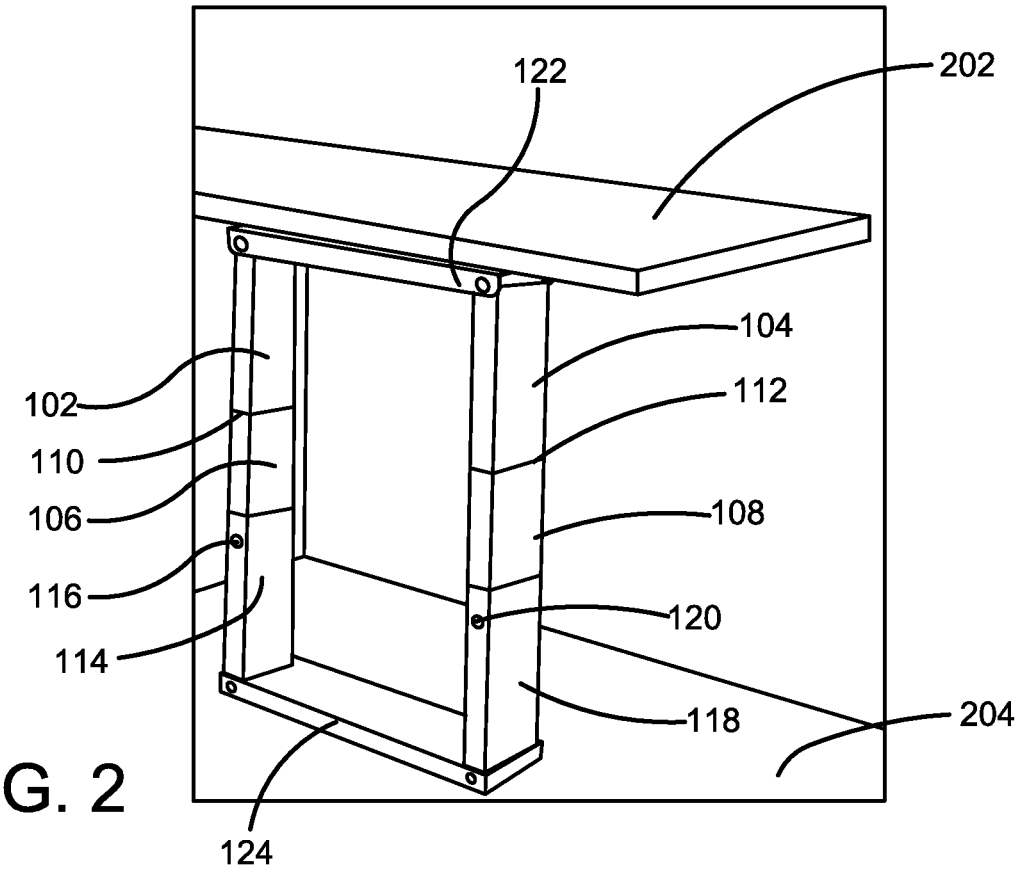
FIG. 2 illustrates a perspective view of one potential embodiment of the kitchen counter collapsible support device of the present invention in an extended orientation and supporting a kitchen counter in accordance with the disclosed architecture.

FIG. 2 illustrates a perspective view of one potential embodiment of kitchen counter collapsible support device of the present invention in an extended form supporting a kitchen counter in accordance with the disclosed architecture. To support a kitchen counter 202 at a greater height, the support device 100 is extended and the height of the device 100 is increased using the built-in telescoping mechanism. The telescoping arms 106, 108 are extended from the sleeves 114, 118 respectively, to increase the height of the device 100. The top supporting member 122 makes contact with an underside of the kitchen counter 202 in the support position, while the base 124 is placed on a floor surface 204.

The left upper arm 102 is permanently and hingedly-connected to the telescoping arm 106 through the hinged joint 110. Similarly, the right upper arm 104 is permanently and hingedly-connected to the telescoping arm 108 through the hinged joint 112. In retracted form, the length of the telescoping arms 106, 108 are enclosed within the telescoping sleeves 114, 118, respectively. The hinged joints 110, 112 remain accessible and allow hinged movement between the upper arms 102, 104 and telescoping arms 106, 108 to enable collapsing of the support device 100 in a folded condition. In an extended form, the telescoping arms 106, 108 extend longitudinally from the sleeves 114, 118 allowing the total longitudinal height of the device 100 to selectively increase. The telescoping arms 106, 108 can be locked at a desired height to securely support the counter 202 during renovation, remediation, mitigation or other similar situations.

The telescoping arm 106 can have a plurality of holes with which the knob 116 can be telescopically-engaged to lock the telescoping arm 106 at a desired height. Similarly, the right telescoping arm 108 can have a plurality of holes with which the knob 120 can be telescopically-engaged to lock the telescoping arm 108 at a desired height.

In the extended form, the height of the support device 100 from the base 124 to the top supporting member 122 can be up to four feet. In the retracted form, the height of the support device 100 from the base 124 to the top supporting member 122 can be up to two feet. The base 124 provides a stable and secure footing for the support device 100 when supporting the kitchen counter 202 or sink. It is to be appreciated that the range of extension enables the support device to provide support to counters, sinks, or bars that are at typical counter, bar and café heights.

Figure 3:
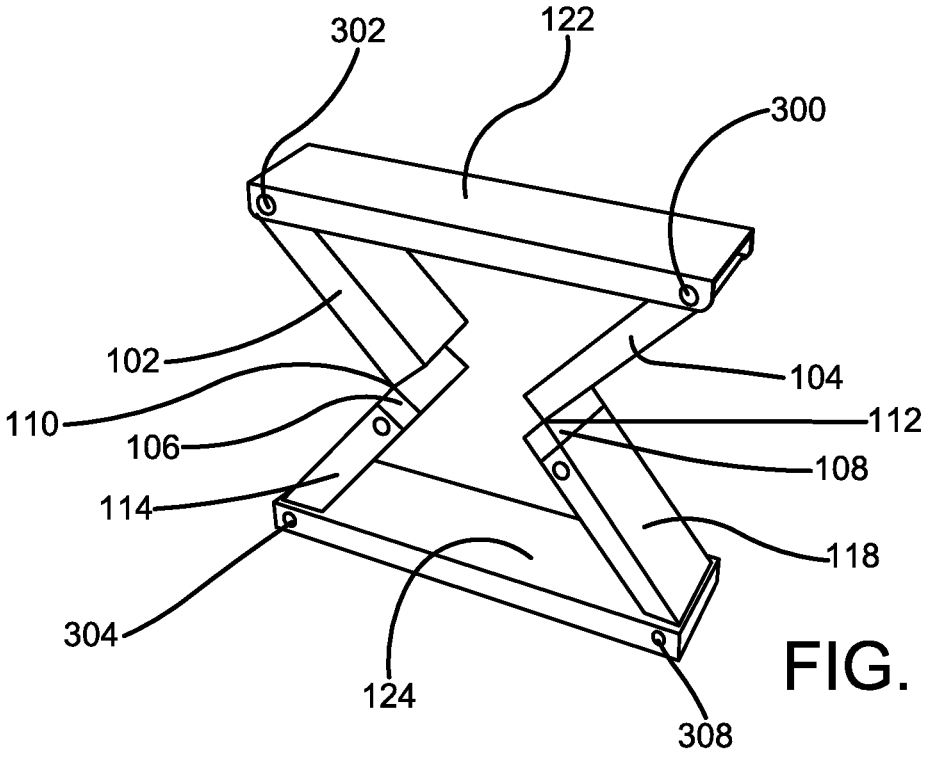
FIG. 3 illustrates a perspective view showing how one potential embodiment of the kitchen counter collapsible support device of the present invention is collapsible using the hinged joints in accordance with the disclosed architecture.

FIG. 3 illustrates a perspective view showing how the support device of the present invention is collapsed using the hinged joints in accordance with the disclosed architecture. To collapse the support device 100 of the present invention, the telescoping arms 106, 108 are retracted such that the hinged joints 110, 112 are accessible just above the top end of the sleeves 114, 118. A small force can be applied at the hinge connections 110, 112 from the outer side toward the inner side. The hinged joint 110 pivots accordingly inward such that the upper left arm 102 and the sleeve 114 with enclosed telescoping arm 106 symmetrically move in a pivot manner. Simultaneously, the hinged joint 112 pivots inward such that the upper right arm 104 and the sleeve 118 with enclosed telescoping arm 108 symmetrically move in a pivot manner.

The first upper arm 102 hingedly-connected to the first telescoping arm 106 includes a range of rotation, and the second upper arm 104 hingedly-connected to the second telescoping arm 108 includes a range of rotation, and the range of rotation is generally about 180 degrees. It is to be appreciated that the first upper arm 102 rotates generally 90 degrees from the extended orientation to the folded orientation. Similarly, the second upper arm 104 rotates generally 90 degrees from the extended orientation to the folded orientation.

The base 124 and the top supporting member 122 of the support device 100 includes a hollow space to accommodate the arms, while the device 100 is in the folded condition. During the pivot movement of the arms 102, 104 and the sleeves 114, 118, the top supporting member 122 moves vertically downwards allowing the arms 102, 104 to be received therein. Similarly, the sleeves 114, 118 can be accommodated and received in a hollow space inside the base 124 when the support device 100 is in the collapsed orientation. The sleeves 114, 118 rotate generally 90 degrees from the extended orientation to the folded orientation The fasteners 302, 306 enable the pivot movements of arms 102, 104 and allow the downward movement of the top supporting member 122. Fasteners 304, 308 enable the pivot movements of sleeves 114, 118 and allow the sleeves 114, 118 to pivot into the hollow space of the base 124.

Figure 4:
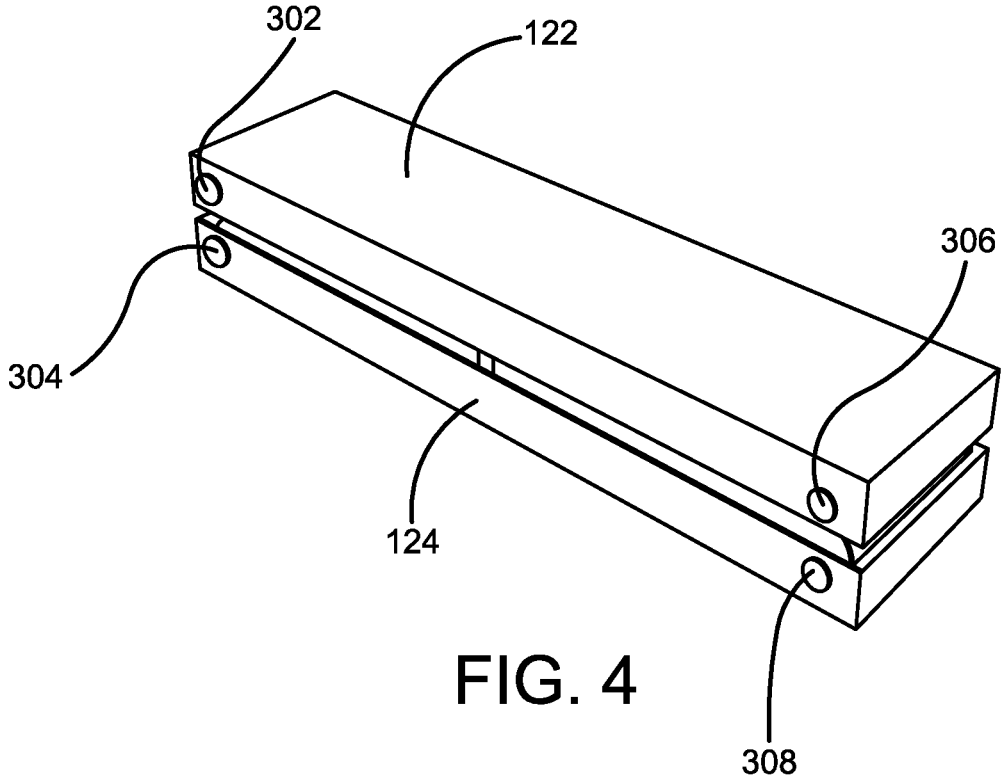
FIG. 4 illustrates a perspective view of the kitchen counter collapsible support device of the present invention in a collapsed and folded orientation in accordance with the disclosed architecture.

FIG. 4 illustrates a perspective view of the kitchen counter collapsible support device of the present invention in a collapsible form in accordance with the disclosed architecture. The support device 100 can be collapsed such that the upper arms and the sleeves with telescoping arms are completely folded and received in the hollow space within the base 124 and top supporting member 122. The fasteners 302, 306 allow downward movement of the top supporting member 122 and also allow the upper arms 102, 104 to be accommodated and received into the hollow space of the top supporting member 122.

The fasteners 304, 308 allow the sleeves with enclosed telescoping arms to be accommodated and received into the hollow space of the base 124. In the folded condition, the upper arms and the sleeves align with each other between the top surface 122 and the base 124, and allow the support device 100 to be portable and stowable in a very compact configuration. In the folded position, the upper arms 102, 104 overlay the sleeves 114, 118 (not illustrated) between the top member 122 and the base member 124. Further, the top member 122 overlays the bottom member 124 in the folded position.

Figure 5:
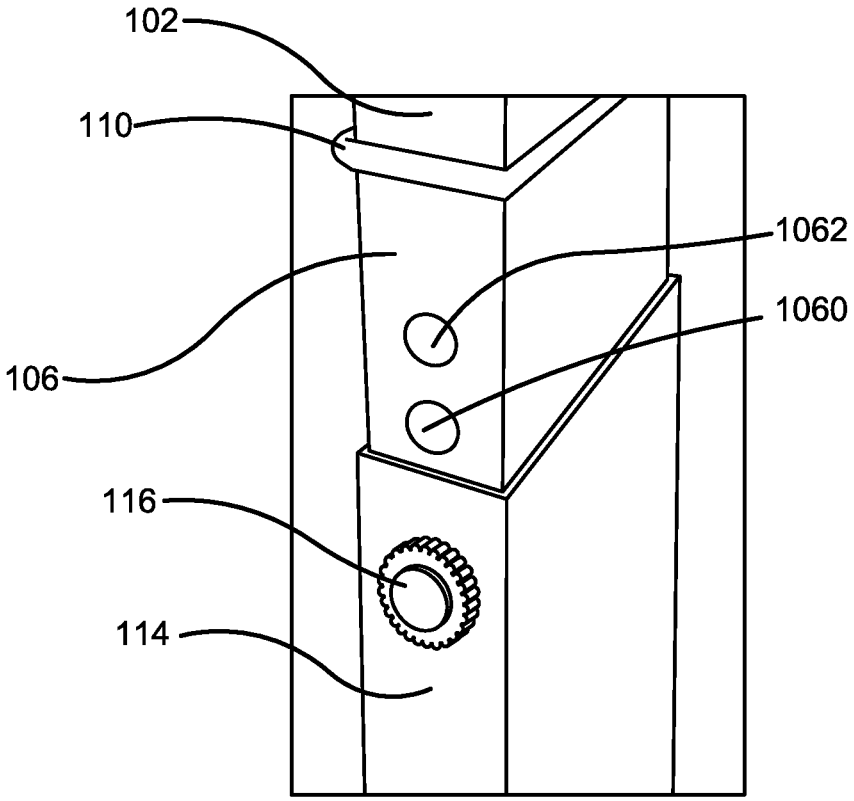
FIG. 5 illustrates a close-up view showing an adjuster knob used in one potential embodiment of the kitchen counter collapsible support device of the present invention in a collapsed orientation in accordance with the disclosed architecture.

FIG. 5 illustrates a close-up perspective view of an adjuster knob used in one potential embodiment of the kitchen counter collapsible support device of the present invention in a collapsible form in accordance with the disclosed architecture. The adjuster knob 116 is used for controlling the length of extension or retraction of the telescoping arm 106 of the support device. The adjuster knob 116 is present on the sleeve 114 and can be engaged to one of the holes in the telescoping arm 106. The adjuster knob 116 can position and lock the telescoping arm 106 at a desired longitudinal height. As shown, selectable holes 1060, 1062 are visible on the telescoping arm 106. It should be noted that any other telescoping means can be used to extend or retract the telescoping arms 106, 108 used in the device of the present invention. In a completely retracted position, the telescoping arm 106 is retracted such that the hinged joint 110 is visible and allows the device to collapse easily. The adjuster knob 116 can be rotated in a clockwise or a counterclockwise direction to engage and disengage, respectively, with a select one of the holes or openings.

The support device 100 of the present invention provides a new lightweight and portable support device for kitchen counters, bars, tables, and other types of surface, and is compatible with a low cost of manufacture with regard to both materials and labor, and which accordingly is then compatible with low prices of sale to the consuming public, thereby making such collapsible support device economically available to the buying public.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "kitchen counter collapsible support device", "collapsible support device", "support device", "collapsible and foldable brace", "device", "prop up device for kitchen counters", "prop up device" and "kitchen counter bracket" are interchangeable and refer to the kitchen counter collapsible support device 100 of the present invention.

Notwithstanding the forgoing, the kitchen counter collapsible support device 100 of the present invention can be of any suitable size and configuration as is known in the art without affecting the overall concept of the invention, provided that it accomplishes the above-stated objectives. One of ordinary skill in the art will appreciate that the size, configuration, and material of the kitchen counter collapsible support device 100 as shown in the FIGS. are for illustrative purposes only, and that many other sizes and shapes of the kitchen counter collapsible support device 100 are well within the scope of the present disclosure. Although the dimensions of the kitchen counter collapsible support device 100 are important design parameters for user convenience, the kitchen counter collapsible support device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A support brace for a countertop or sink, wherein the support brace is collapsible and foldable and comprises:

a first telescoping arm;

a second telescoping arm;

a lateral top support member;

a lateral base member;

a first longitudinal upper arm pivotally connected to said lateral top support member at a top end, wherein said first longitudinal upper arm is hingedly connected to said first telescoping arm at a bottom end;

said first telescoping arm is configured to extend and retract from a first telescoping sleeve, wherein said first telescoping sleeve is pivotally fastened to said lateral base member;

a second longitudinal upper arm pivotally connected to said lateral top support member at the top end, wherein said second longitudinal upper arm is hingedly connected to said second telescoping arm at the bottom end;

said second telescoping arm is configured to extend and retract from a second telescoping sleeve, wherein said second telescoping sleeve is pivotally fastened to said lateral base member;

said first and second longitudinal upper arms and said first and second telescoping arms are configured to selectively fold whereby said lateral top support member is positioned proximal to and aligned with said base member when said support brace is in a folded orientation;

wherein said support brace consisting of a first adjuster knob for retaining said first telescoping arm in said first telescoping sleeve at a selectable extension therein, and a second adjuster knob for retaining said second telescoping arm in said second telescoping sleeve at said selectable extension therein; and further wherein said selectable extension extends said support brace to a pre-existing height of the countertop.

2. The support brace of claim 1, wherein each of said first longitudinal upper arm and said second longitudinal upper arm are laterally received within said lateral top support member when said support brace is in the folded orientation.

3. The support brace of claim 2, wherein said first telescoping arm and said second telescoping arm are laterally received within said base member when said support brace is in the folded orientation.

4. The support brace of claim 1, wherein said first telescoping arm aligns with and supports said first longitudinal upper arm when said support brace is in an extended orientation.

5. The support brace of claim 4, wherein said second telescoping arm aligns with and supports said second longitudinal upper arm when said support brace is in the extended orientation.

6. The support brace of claim 5, wherein said first longitudinal upper arm is hingedly connected to said first telescoping arm and includes a range of rotation, and said second longitudinal upper arm is hingedly connected to said second telescoping arm and includes the range of rotation, and further wherein said range of rotation is generally about 180 degrees.

7. The support brace of claim 6, wherein said first longitudinal upper arm rotates generally 90 degrees from said extended orientation to said folded orientation.

8. The support brace of claim 7, wherein said second longitudinal upper arm rotates generally 90 degrees from said extended orientation to said folded orientation.

9. The support brace of claim 8, wherein said first telescoping sleeve rotates generally 90 degrees from said extended orientation to said folded orientation.

10. The support brace of claim 9, wherein said second telescoping sleeve rotates generally 90 degrees from said extended orientation to said folded orientation.

11. A support brace for a counter or a sink, the support brace being both collapsible and foldable and consisting of:

a first and a second telescoping arm;

a top support member;

a base member;

a first upper arm pivotally connected to said top support member at a top end;

said first upper arm is hingedly connected to said first telescoping arm at a bottom end including a range of rotation therebetween;

said first telescoping arm is configured to extend and retract from a first telescoping sleeve; said first telescoping sleeve is pivotally fastened to said base member;

a second upper arm pivotally connected to said top support member at the top end;

said second upper arm is hingedly connected to said second telescoping arm at the bottom end including said range of rotation therebetween;

said range of rotation is generally about 180 degrees;

said second telescoping arm is configured to extend and retract from a second telescoping sleeve;

said second telescoping sleeve is pivotally fastened to said base member;

said first and second upper arms and said first and second telescoping arms are configured to selectively fold whereby said top support member is positioned proximal to and aligned with said base member when said support brace is in a folded orientation;

wherein said support brace consisting of a first adjuster knob for retaining said first telescoping arm in said first telescoping sleeve at a selectable extension therein, and a second adjuster knob for retaining said second telescoping arm in said second telescoping sleeve at said selectable extension therein; and further wherein said selectable extension extends said support brace to a pre-existing height of the counter.

12. The support brace of claim 11, wherein said first upper arm and said second upper arm are laterally received within said top support member when said support brace is in the folded orientation.

13. The support brace of claim 12, wherein said first telescoping arm and said second telescoping arm are laterally received within said base member when said support brace is in the folded orientation.

14. The support brace of claim 13, wherein said first telescoping arm aligns with and supports said first upper arm when said support brace is in an extended orientation.

15. The support brace of claim 14, wherein said second telescoping arm aligns with and supports said second upper arm when said support brace is in the extended orientation.

16. The support brace of claim 15, wherein said first upper arm rotates generally 90 degrees from said extended orientation to said folded orientation.

17. The support brace of claim 16, wherein said second upper arm rotates generally 90 degrees from said extended orientation to said folded orientation.

18. A collapsible and foldable support brace for a counter or a sink, the collapsible and foldable support brace comprising:

a first and a second telescoping arm;

a top support member;

a base member;

a first upper arm pivotally connected to said top support member at a top end;

said first upper arm is hingedly connected to said first telescoping arm at a bottom end including a range of rotation therebetween;

said first telescoping arm is configured to extend and retract from a first telescoping sleeve; said first telescoping sleeve is pivotally fastened to said base member;

a second longitudinal upper arm pivotally connected to said top support member at the top end;

said second upper arm is hingedly connected to said second telescoping arm at the bottom end including said range of rotation therebetween;

said range of rotation is generally about 180 degrees;

said second telescoping arm is configured to extend and retract from a second telescoping sleeve;

said second telescoping sleeve is pivotally fastened to said base member;

wherein said foldable support brace consisting of a first adjuster knob for retaining said first telescoping arm in said first telescoping sleeve at a selectable extension therein and a second adjuster knob for retaining said second telescoping arm in said second telescoping sleeve at said selectable extension therein; and further wherein said selectable extension extends said foldable support brace to a pre-existing height of the counter.

19. The collapsible and foldable support brace of claim 18, wherein said first upper arm and said second upper arm are laterally received within said top support member when said support brace is in the folded orientation, and further wherein said first telescoping arm and said second telescoping arm are laterally received within said base member when said support brace is in the folded orientation.

20. The collapsible and foldable support brace of claim 19, wherein said first upper arm rotates generally 90 degrees from said extended orientation to said folded orientation, and further wherein said second upper arm rotates generally 90 degrees from said extended orientation to said folded orientation.

* * * * *